US005722193A

United States Patent [19]

Post

[11] Patent Number: 5,722,193

[45] Date of Patent: Mar. 3, 1998

[54] FIRING MECHANISM FOR A MUZZLE-LOADED RIFLE

[76] Inventor: Thomas R. Post, 3865 Hershey Rd., Erie, Pa. 16506

[21] Appl. No.: 756,155

[22] Filed: Nov. 25, 1996

[51] Int. Cl.[6] ..... F41C 9/08

[52] U.S. Cl. ..... 42/51; 89/1.3

[58] Field of Search ..... 42/51; 89/1.3

[56] References Cited

U.S. PATENT DOCUMENTS

| | | | |
|---|---|---|---|
| 2,477,253 | 7/1949 | Jasse | 89/1.3 |
| 4,715,139 | 12/1987 | Rodney, Jr. | 42/51 |
| 5,467,551 | 11/1995 | Kruse | 42/51 |

FOREIGN PATENT DOCUMENTS

| | | | |
|---|---|---|---|
| 168396 | 8/1921 | United Kingdom | 89/1.3 |

*Primary Examiner*—Stephen M. Johnson
*Attorney, Agent, or Firm*—Richard K. Thomson

[57] ABSTRACT

A firing mechanism having an action housing whose rotation simultaneously cocks the weapon and engages the safety. The rotation also provides access to a nipple that supports a percussion cap ignitor that is positioned underneath the weapon so that the exhaust gases are propelled downwardly and the ignitor cap is protected from the weather. The trigger pull force and distance can be individually adjusted to the preferences of the firer.

19 Claims, 7 Drawing Sheets

FIRING MECHANISM FOR A MUZZLE-LOADED RIFLE

FIELD OF THE INVENTION

The present invention relates to muzzle-loaded rifles. More particularly, the present invention relates to improvements in the firing mechanism of such a rifle.

BACKGROUND OF THE INVENTION

Many of today's state-of-the-art muzzle-loading rifles employ a protruding nipple that receives a percussion cap ignitor and is accessed from the top of the weapon. While this certainly provides a measure of convenience, it also results in an upward flash and puff of exhaust gases into the rifle firer's line of vision and, in some cases, toward her/his face that, at the very least, can distract her/him from the target. A firer may, consciously or subconsciously, flinch knowing the exhaust is coming, jerking the trigger and missing the target. Even for the most steely-eyed, seasoned weapon's firer, the exhaust is an annoyance. In addition, since the nipple is accessible from the top, it is susceptible to inclement weather and use of certain sighting mechanisms is inhibited or prohibited, since they would overlie and interfere with the nipple opening and restrict access thereto.

Preferences regarding trigger pull pressure and distance are as individual as the weapon's firer. Accordingly, the ability to independently adjust these features would be an important characteristic of the weapon. Further, weapon safety is important to everyone, so an effective safely mechanism is essential.

SUMMARY OF THE INVENTION

The present invention provides a nipple for the percussion cap that in operation, is surrounded on the top, front, back and two lateral sides by structure such that the exhaust gases escape downwardly in front of the trigger guard. Since the nipple is underneath the weapon and surrounded as above described, it is protected from inclement weather and offers no interference to the use of any type of sighting device.

In addition, the present invention provides the capability to adjust both the trigger pull pressure as well as means to separately adjust the pull distance. A striker is spring-loaded toward a forward fired position and is retained in a rearward to-be-fired position by a pivotable sear link. The pivotable sear link has a first pivoted end and a second pivotable end, the pivotable end being engaged by a first end of a plunger. The second opposite end of the plunger is engaged by a trigger.

The plunger is biased by a spring to a first lower sear-engaging position, the spring biasing said plunger being compressed between an enlarged head portion of said plunger and a floating compression plate. The position of said floating compression plate can be adjusted by an adjustment screw to, in turn, adjust a spring compression of said spring biasing the plunger. The spring compression force is directly proportional to a trigger pull force: the force required to pivot the trigger, pushing the plunger upwardly unseating the sear link allowing the striker to be propelled into the ignitor cap. A second parallel spring extending along the shank of the force adjustment screw engages said compression plate to prevent its canting. A second trigger adjustment screw is provided to manually control a distance the trigger must move to effect firing.

Finally, the pivoting of the action housing to provide access to the nipple for installation of the percussion cap simultaneously cocks the firing mechanism and engages the safety. The action housing with its contained firing mechanism may be easily removed from its pivot and may also be easily disassembled from the barrel/breach and stock assembly to afford access to the surfaces of the various parts for cleaning.

Various other features, advantages and characteristics of the present invention will become apparent to a person of ordinary skill in the art after a reading of the following specification.

BRIEF DESCRIPTION OF THE DRAWINGS

At least one preferred embodiment of the present invention is described in conjunction with the following figures, like parts bearing like reference numerals, in which.

DETAILED DESCRIPTION OF THE INVENTION

Figure 1:
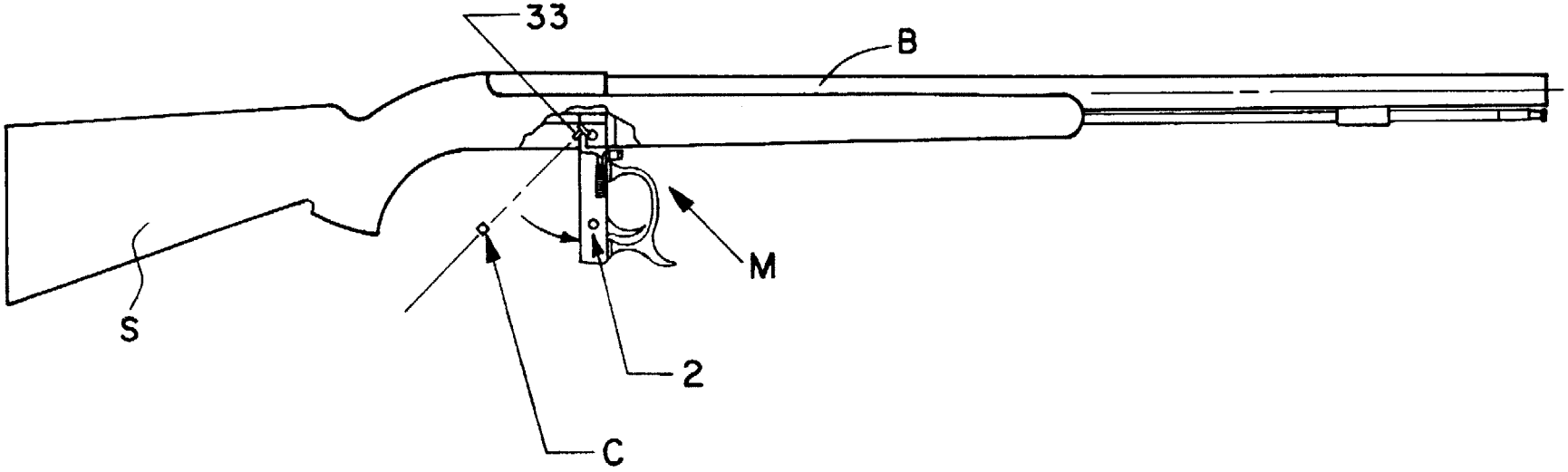
FIG. 1 is a side view of a muzzle-loading rifle equipped with the features of the present invention with parts broken away to show detailed features.
Figure 2:
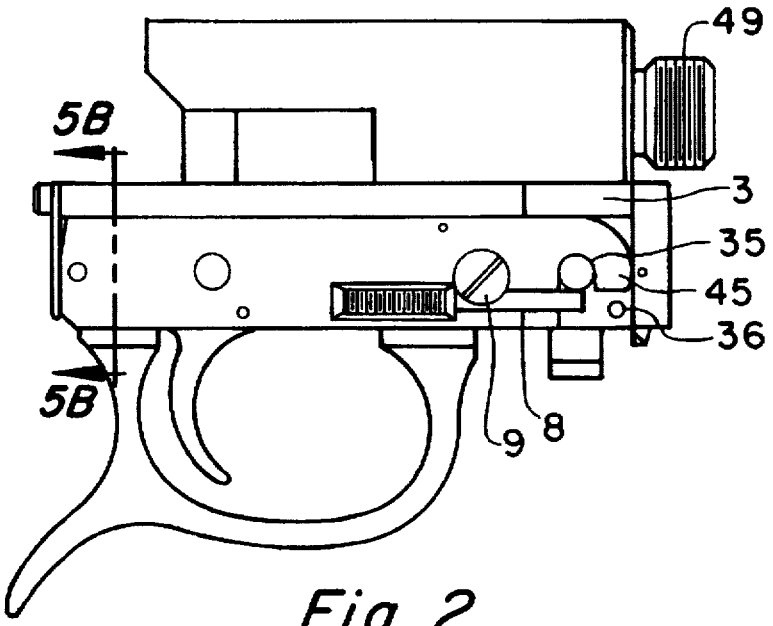
FIG. 2 is a side view of the right hand side of the breech plug and the action housing of the present invention.
Figure 3:
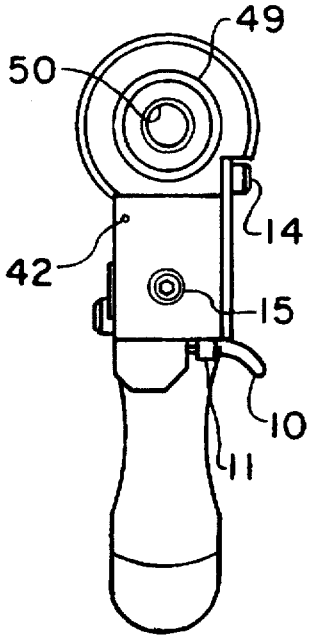
FIG. 3 is a front view of the mechanism shown in FIG. 2.

FIG. 1 depicts the position of the firing mechanism M, which contains the inventive features of the present application, with the action housing 2 shown in the cocking position relative to the stock S with barrel B threadedly connected to an end portion of firing mechanism M. When action housing 2 is in the cocking position, nipple 33 is accessible from beneath the weapon to install percussion cap C thereupon. Firing mechanism M can be better seen in FIGS. 2–7C.

FIGS. 2–6 B show action housing 2 pivotably connected to priming block 3 by action pivot pin 35. A hook 45 on action housing 2 engages pin 35 and slide action retainer 8 slides under pin 35 to retain action housing 2 on pivot priming block 3 which is threadedly affixed to breach plug 1. Retainer 8 is biased to its forward, engaging position by slide plunger 40 under influence of slide plunger spring 41 (FIG. 5A). Actuator 8' (FIG. 6B) of slide action retainer 8 can be manually engaged and pulled rearwardly against the pressure of spring 41 to enable the action housing to be easily disassembled from pivot priming block 3 to enable further disassembly for cleaning. Slide stop screw 9 provides a limit for the forward bias of retainer 8 by spring 41.

Figure 5A:
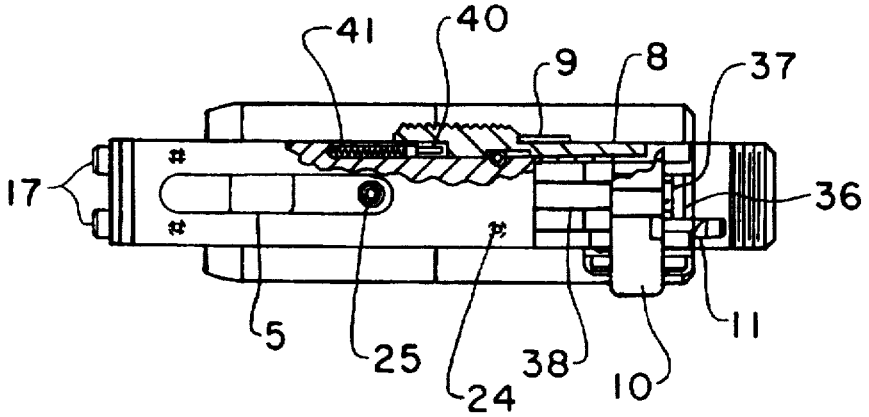
FIG. 5A is a bottom view of the action housing with portions broken away.
Figure 4:
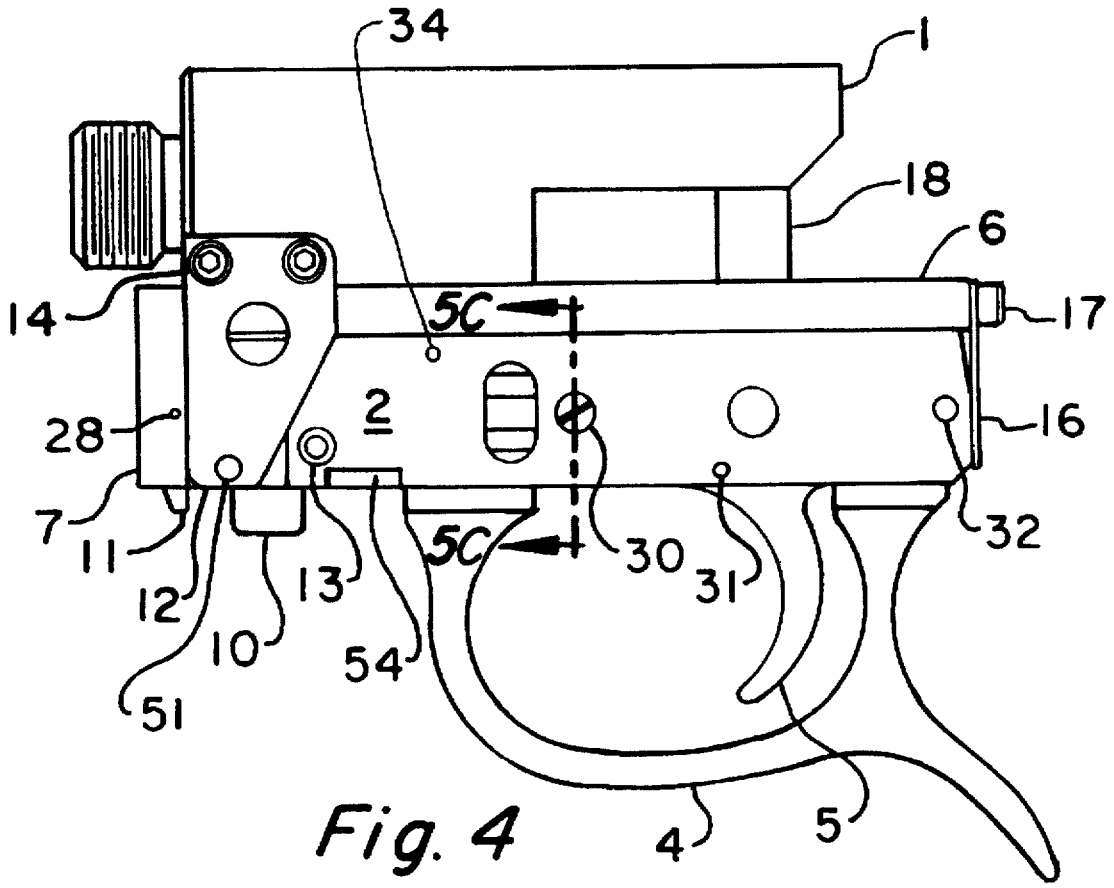
FIG. 4 is a side view of the left hand side of the mechanism shown in FIG. 2.
Figure 5B:
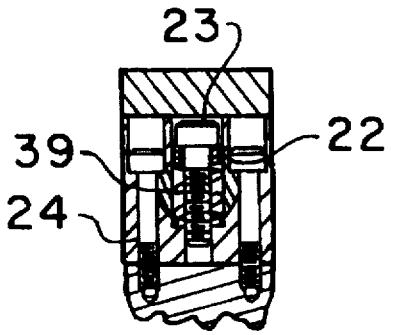
FIG. 5B is a cross-sectional front view of the mechanism as seen along line 5B—5B of FIG. 2.

The leading end of breech plug 1 has threaded attachment 49 to which barrel B will be connected. Breech plug 1 provides closure for the trailing end of barrel B and has a recess 50 which is coaxial with the throughbore of the barrel. (FIG. 7 B). Stock plate 6 will engage in a recess in the stock S. Stock plate 6 is attached to breech plug 1 by stock screw 48 and plate screw 19 (FIG. 7 B), stock screw 48 extending through stock bushing 18. Pivot priming block 3 is threaded into breech block 1 and has a vertically extending primer chamber 52. Trigger 5 is protected from accidental engagement by trigger guard 4 which is connected to action housing 2 by a plurality of screws 24 (FIG. 5B). Typically four screws 24 will be used, two in front and two in the rear of the trigger guard 4. Other means of attachment may be employed in lieu of screws such as studs, or the like. Action catch plate 16 is secured to the stock plate 6 by catch screws 17 (FIG. 5A). Plate 16 functions as a catch spring which engages action housing 2 to retain it in its upper, firing position. Action plug 44 is held in action housing 2 by pin 32 (FIG. 7B) and plugs the trailing end thereof.

Figure 6A:
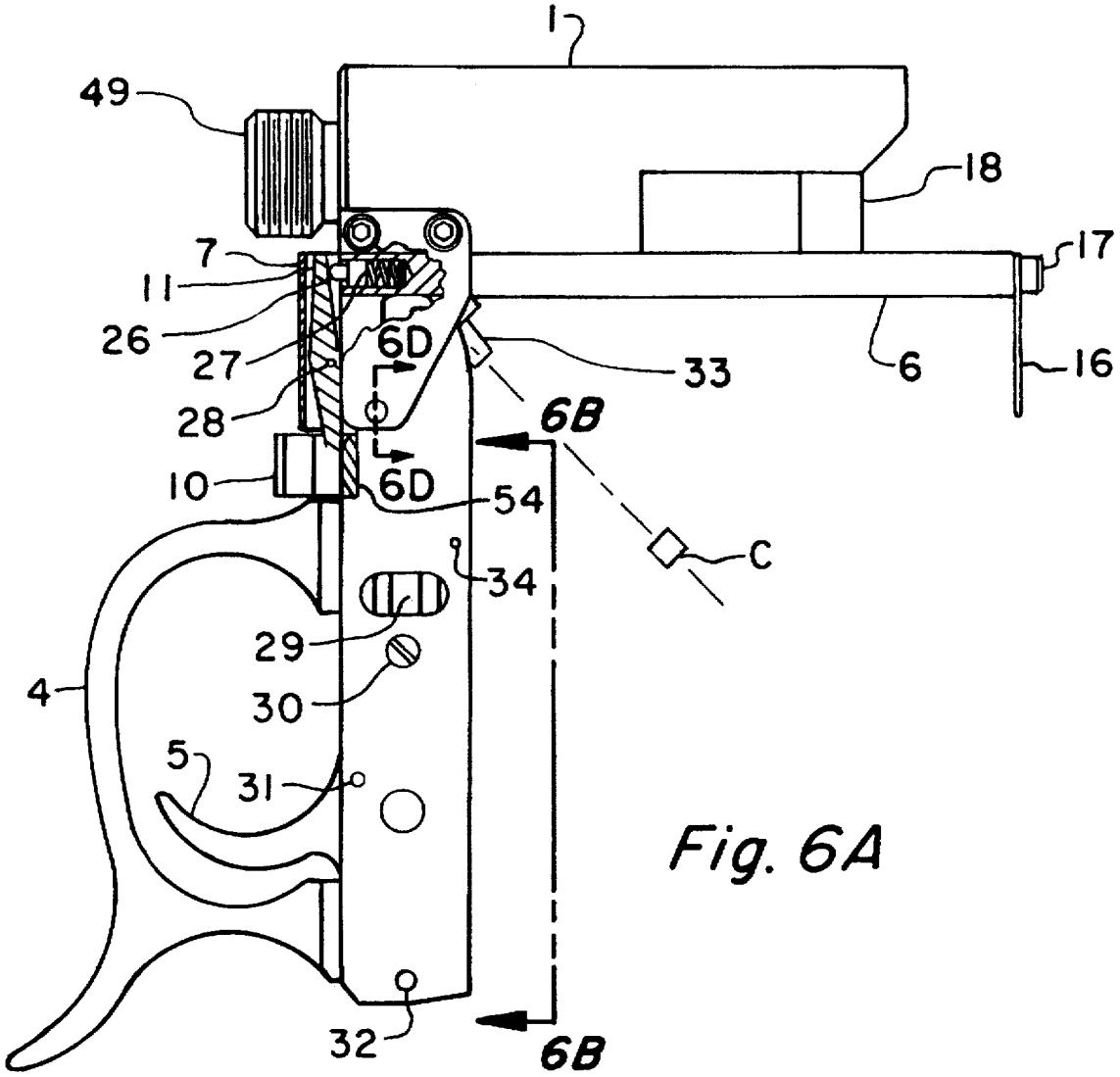
FIG. 6A is a left hand side view with the action housing in the cocking position and having parts broken away.
Figure 6D:
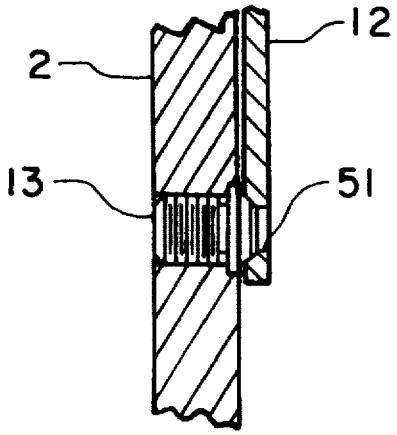
FIG. 6D is a cross-sectional front view as seen along line 6D—6D of FIG. 6A.
Figure 6B:
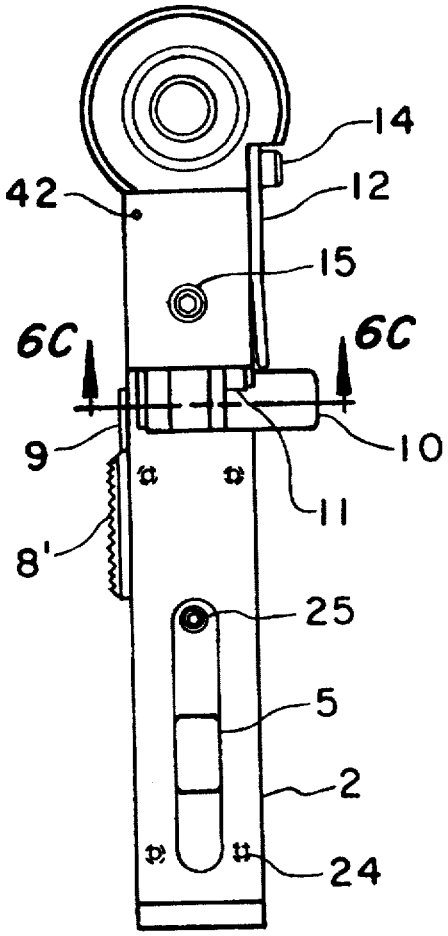
FIG. 6B is a front view of the mechanism as shown in FIG. 6 A.
Figure 6C:
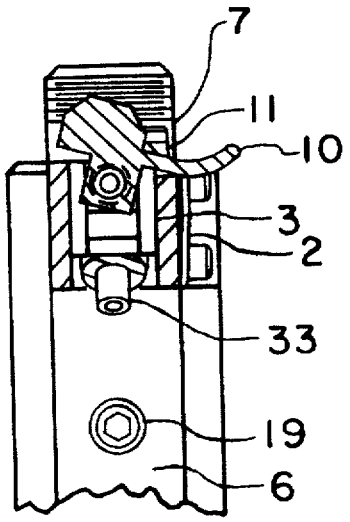
FIG. 6C is a cross-sectional bottom view as seen along line 6C—6C of FIG. 6B.

Detent plate spring 12 extends along the left side of breech plug 1 and the pivot priming block 3 and is attached to breech plug 1 by detent screws 14. Detent plate spring 12 has a hole 51 therein that receives detent stud 13 that is threaded into action housing 2 (FIG. 6D). When the action housing 2 is manually disengaged from plate spring 16 and moved to its extended position (FIG. 6 A), detent stud 13 will engage in hole 51 of detent spring 12 and hold it in the extended position (FIG. 6D). This will permit the weapon to be turned over to provide better access to the nipple 33 to permit a percussion cap ignitor C to be positioned thereon without the action housing collapsing to its closed position. The positioning of the ignitor cap nipple underneath protects it from inclement weather. In addition, nipple 33 is surrounded, with the exception of beneath it, by structure: stock plate 6 above, action housing 2 behind and on either side, and pivot priming block 3 and safety 10 in the front. The ignition gases will, therefore, exhaust downwardly away from the firer's face.

Safety lever block 7 is attached to the front side of pivot priming block 3 by screw 15, a portion of block 7 extending along the underside of action housing 2. Block locating pin 42 extends through a hole in block 7 into pivot priming block 3 to properly position block 7 relative to priming block 3. Screw 15 also threadingly engages action pivot pin 35 securing it to the back side of priming block 3 (FIG. 7B). Safety lever block 7 houses safety actuator lever 11. Lever 11 is biased by spring 2 7 through plunger 26 to pivot around lever pivot pin 28 (FIG. 6A). The opposite end of lever 11 engages safety 10. It is necessary for lever 11 to be spring-biased because at the time lever 11 engages safety 10 to pivot it upwardly into engagement slot 54, safety 10 is still moving longitudinally.

Figure 7A:
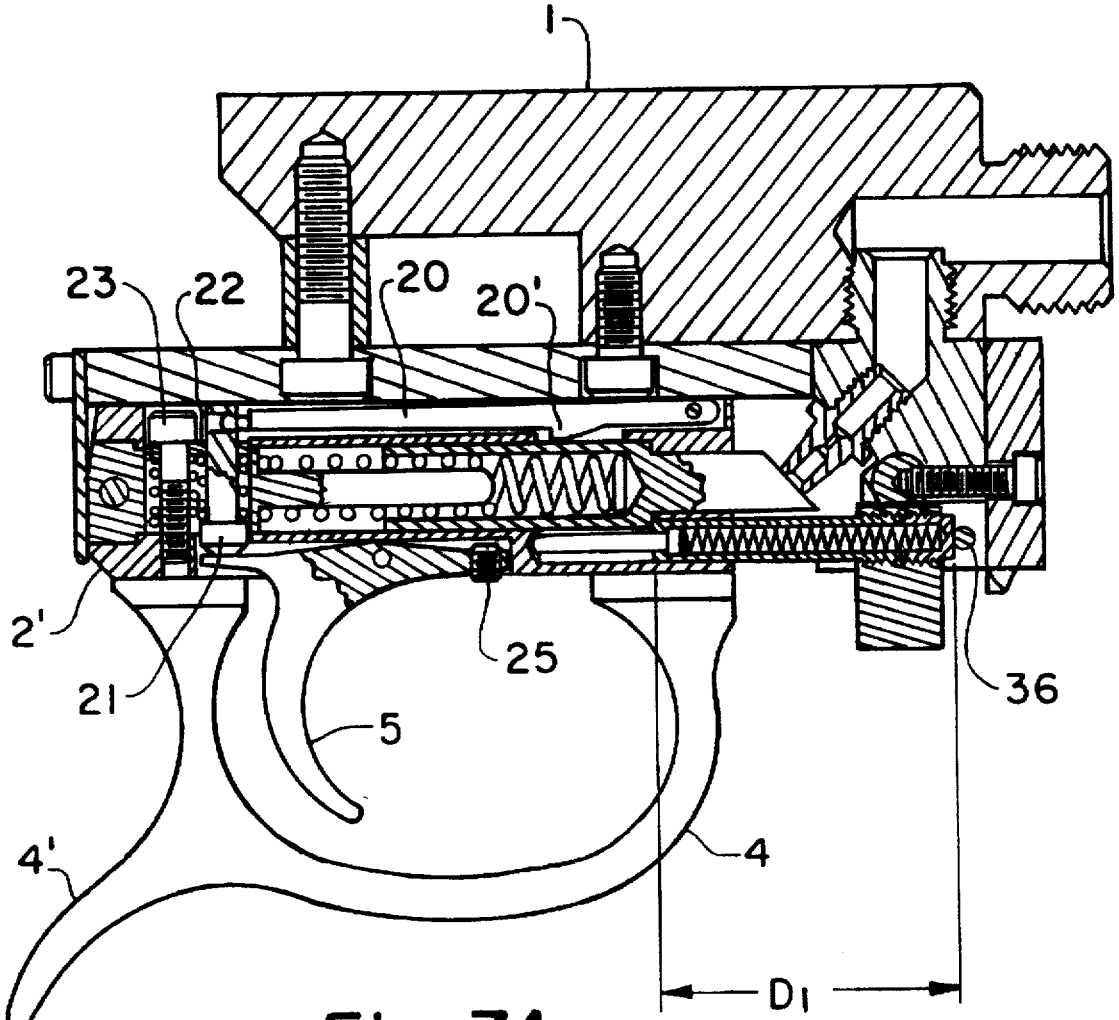
FIG. 7A is a right hand cross-sectional side view showing the striker in the as-fired position.
Figure 7C:
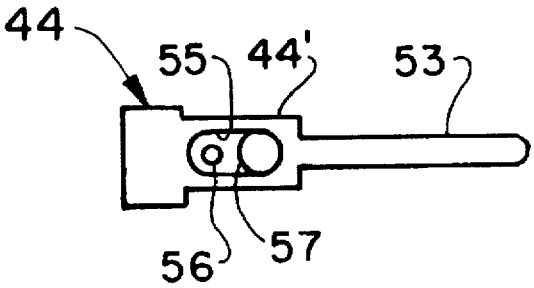
FIG. 7C is a top view of the action plug of the present invention.
Figure 7B:
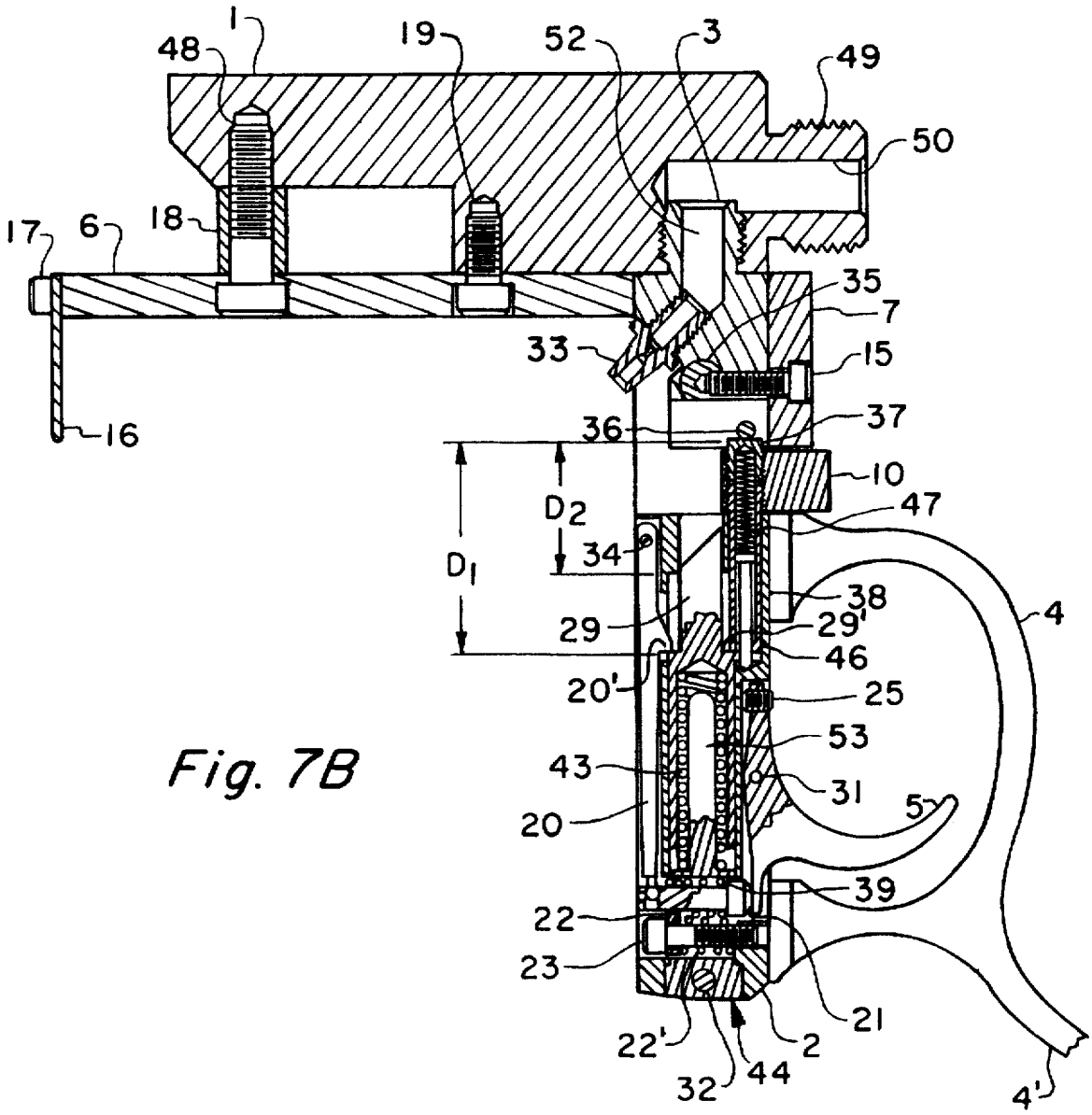
FIG. 7B is a right hand cross-sectional side view with the action housing in the cocking position.

As best seen in FIGS. 7A and 7B, the action housing 2 of firing mechanism M contains sear link 20 which is pivoted at a first end by sear pivot pin 34 to action housing 2. The opposite end of sear link 20 is received in a recess in the trigger transfer plunger 21. The trigger force spring 39 acts between the head of transfer plunger 21 and a spring compression plate 22. Plate 22 can slide longitudinally along plunger 21 but is biased to an upper position by trigger force spring 39 and canting prevention spring 22' on force adjustment screw 23. As its name implies, spring 22' prevents compression plate 22 from canting, and possibly wedging, in the action housing 2.

Figure 5C:
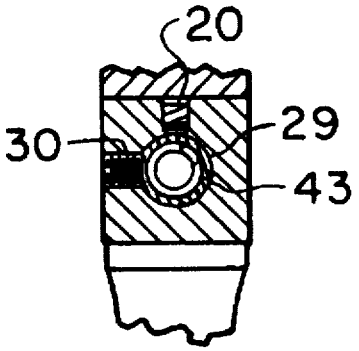
FIG. 5C is a cross-sectional rear view of a portion of the mechanism as seen along line 5C—5C of FIG. 4.

Striker 29 is mounted for reciprocal movement in action housing 2 and its radial position adjusted by set screw 30 (FIG. 5 C). The aft end of striker 29 is hollow and receives main spring 43 which rides upon guide plunger 53. Sear detent 20' engages an upper portion of annular shoulder 29' on striker 29. A lower portion of shoulder 29' is engaged by the rear of cocking plunger 38. The leading end of plunger 38, or cocking plunger bearing 37, rests against stop pin 36 in the discharged position (FIG. 7A). By gripping the trailing end 4' of the trigger guard and pivoting the action housing 2 forwardly down around action pivot pin 35, stop pin 36 moves cocking plunger 38 and striker 29 rearwardly against the force of main spring 43 until sear detent 20' engages shoulder 29'. Trigger force spring 39 will pivot sear link 20 downwardly as soon as detent 20' clears shoulder 29' simultaneously pivoting trigger 5 about trigger pivot pin 31 until trigger adjustment screw 25 bottoms against action housing 2.

This motion simultaneously moves safety 10 rearward against the force of safety return spring 47, since cocking plunger bearing 37 is threaded into safety 10 (FIG. 7B). As the action housing 2 nears the end of its pivotal motion, safety 10 is engaged by spring-biased safety actuator lever 11 exerting an upward (toward the action housing 2) force on safety 10. When safety 10 has completed its rearward travel, lever 11 pushes it into notch 54. In this position, safety 10 prevents the striker 29 from traveling forward since striker shoulder 29' is in engagement with cocking plunger 38 which is held in its rearmost position by safety 10. To disengage the safety 10, laterally extending safety lever 10' is pivoted downwardly out of notch 54 allowing safety return spring 47 to move safety 10 (and, hence, cocking plunger 38) to its forwardmost position in contact with cocking plunger bearing 37. Striker 29 is now free to move forward during firing.

FIG. 7C shows a detail of action housing plug 44. Guide plunger 53 is formed integrally as an extension of action plug 44. The intermediate body portion 44' of action plug 44 has an ovoid recess 55 formed therein which receives canting prevention plate 22 and provides it a space in which to move. In addition, recess 55 has a first threaded hole 56 which receives the leading end of adjustment screw 23 which threads through hole 56 into trailing end 2' of action housing 2. Second hole 57 receives transfer plunger 21 and springs 22' and 39 are received in recess 55. The front surface of intermediate body portion 44' provides a reaction surface for main spring 43.

By adjusting the position of trigger adjustment screw 25, the amount of engagement between sear detent 20' and shoulder 29' can be adjusted such that the amount of distance the trigger must be pulled can be adjusted independently of the trigger pull force.

By advancing screw 23, compression plate 22 will additionally compress trigger force spring 39 thereby requiring additional pull force on trigger 5 to move transfer plunger 21 and pivot sear link 20. The pivoting motion of link 20 will cause the sear detent 20' to disengage from the upper portion of annular shoulder 29' on striker 29 causing it to be propelled forward under impulse of main spring 43. The leading end of striker 29 has a bevel angle on it that matches the tilt angle of the nipple 33 so that it strikes the ignitor cap mounted thereon sending the ignition spark through the nipple 33 igniting the primer powder in the vertical primer chamber 52 igniting the main charge of powder and discharging the weapon.

Various changes, alternatives and modifications will become apparent to a person of ordinary skill in the art following a reading of the foregoing specification. It is intended that all such changes, alternatives and modifications as come within the scope of the appended claims be considered part of the present invention.

I claim:

1. A muzzle-loading rifle comprising:

a) a barrel having an axial throughbore;

b) a breach plug connected to and providing closure for one end of said barrel, said breach plug having a recess which extends coaxially with the axial throughbore of said barrel;

c) a primer chamber extending upwardly to intersect said recess;

d) a nipple for supporting a percussion cap ignitor, said nipple being surrounded on the top, back and both lateral sides by structure;

e) a striker for percussively engaging said percussion cap ignitor wherein i) said striker moves along a second axis positioned generally below a first axis which contains said barrel and ii) said nipple is angled to at least partially bridge the distance between said first and second axes;

whereby any exhaust from said percussion cap ignitor will project downwardly away from the face of the rifle's firer.

2. The muzzle-loading rifle of claim 1 wherein said upwardly extending primer chamber substantially bridges the remaining distance between said first and second axes.

3. The muzzle-loading rifle of claim 1 further comprising a pivotable action housing which can be rotated downwardly about one end relative to a priming block to provide access to said nipple, this rotation and the angling of said nipple providing easy access to said nipple for placement of said percussion cap.

4. The muzzle-loaded rifle of claim 3 wherein the rotation of said action housing also cocks a firing mechanism of said rifle.

5. The muzzle-loaded rifle of claim 4 wherein the rotation of said action housing automatically engages a safety on said firing mechanism.

6. The muzzle-loaded rifle of claim 4 further comprising securement means connecting said action housing to said breach plug whereby said securement means may be easily disengaged to facilitate cleaning of said action housing.

7. The muzzle-loaded rifle of claim 6 wherein said action housing may be easily disassembled into its component parts to permit cleaning therof.

8. The muzzle-loaded rifle of claim 3 further comprising a detent stud to hold said action housing in its open position to free up said firer's hand to install said firing cap.

9. The muzzle-loading rifle of claim 1 wherein said striker is spring-loaded toward a forward fired position and is retained in a rearward to-be-fired position by a pivotable sear link, said pivotable sear link having a first pivoted end and a second pivotable end.

10. The muzzle-loading rifle of claim 9 wherein said pivotable end is engaged by a first end of a plunger, said plunger having a second end engaged with a trigger.

11. The muzzle-loading rifle of claim 10 wherein said plunger is biased by a spring to a first position away from said pivotable sear link.

12. The muzzle-loading rifle of claim 11, wherein said spring biasing said plunger is compressed between an enlarged head portion of said plunger and a floating compression plate.

13. The muzzle-loading rifle of claim 12 wherein a position of said floating compression plate can be adjusted by an adjustment screw to, in turn, adjust a spring compression of said spring biasing the plunger which is proportional to a trigger pull force.

14. The muzzle-loading rifle of claim 13 further comprising a second spring extending along said adjustment screw and engaging said compression plate to prevent its canting.

15. The muzzle-loading rifle of claim 14 further comprising a second adjustment screw to manually control a distance the trigger must move to effect firing.

16. A firing mechanism for a muzzle-loading rifle comprising a) a striker movable from a first weapon-cocked position to a second weapon-fired position, said striker having a protruding shoulder extending upwardly from a portion thereof;

b) spring means for biasing said striker toward said second weapon-fired position;

c) a pivotable sear link having a first pivoted end and a second pivotable end pivotable from a first lower position to a second upper position, said sear link having a downwardly extending detent that engages said upwardly extending shoulder retaining said striker in said first position when it is in its first lower position;

d) a trigger mechanism which is substantially T-shaped, said trigger being pivoted about a pin at the juncture of said T-shaped trigger;

e) a headed plunger extending from a first end which is connected to said pivotable end of said sear link to a second end which rests on one arm of said T-shaped trigger and movable with said pivotable end of said sear link between its first lower and second upper positions;

f) a floating compression plate slidable along a portion of said plunger;

g) a spring extending between said compression plate and a head portion of said plunger biasing said plunger and said connected pivotable end of sear link to its first lower position;

h) means to adjust a first amount of force exerted by said compression plate on said spring, said first amount of force being proportional to a second amount of force required to be administered to an upright member of said T-shaped trigger to pivot said pivotable end of said sear link releasing said striker to fire said muzzle-loaded rifle.

17. The firing mechanism of claim 16 further comprising a separate means to adjust a distance through which said trigger must be pulled in order to fire said muzzle-loaded rifle.

18. The firing mechanism of claim 16 in which said means to adjust said first amount of force comprises an adjustment screw which extends through an opening in said compression plate.

19. The firing mechanism of claim 18 further comprising a second leveling spring surrounding said adjustment screw and engaging said compression plate to prevent its canting.

* * * * *